US007389707B2

(12) United States Patent
Murase et al.

(10) Patent No.: US 7,389,707 B2
(45) Date of Patent: Jun. 24, 2008

(54) STARTER WITH ONE-WAY CLUTCH FOR CRANKING INTERNAL COMBUSTION ENGINE

(75) Inventors: Kazuaki Murase, Konan (JP); Youichi Hasegawa, Kasugai (JP); Kei Shibayama, Nagoya (JP)

(73) Assignee: Denso Corporation, Kariya (JP)

( * ) Notice: Subject to any disclaimer, the term of this patent is extended or adjusted under 35 U.S.C. 154(b) by 718 days.

(21) Appl. No.: 10/944,936

(22) Filed: Sep. 21, 2004

(65) Prior Publication Data

US 2005/0081659 A1 Apr. 21, 2005

(30) Foreign Application Priority Data

Oct. 16, 2003 (JP) ..... 2003-356344

(51) Int. Cl.
*F01N 1/00* (2006.01)

(52) U.S. Cl. ..... 74/7 C; 74/7 A

(58) Field of Classification Search ..... 74/6, 74/7 C, 7 A; 192/42, 45
See application file for complete search history.

(56) References Cited

U.S. PATENT DOCUMENTS

| | | | | |
|---|---|---|---|---|
| 5,014,563 | A | 5/1991 | Isozumi | |
| 5,129,270 | A | 7/1992 | Hasebe | |
| 5,528,945 | A * | 6/1996 | Okada | 74/7 A |
| 5,547,291 | A | 8/1996 | Miyazaki et al. | |
| 5,549,011 | A * | 8/1996 | Shiga et al. | 74/7 E |
| 5,596,902 | A * | 1/1997 | McMillen | 74/7 C |
| 5,706,700 | A * | 1/1998 | Takagi et al. | 74/7 C |
| 5,818,118 | A * | 10/1998 | Kimura et al. | 290/48 |
| 5,957,592 | A | 9/1999 | Yamanaka | |
| 6,014,913 | A | 1/2000 | Masahiro | |
| 6,142,028 | A * | 11/2000 | Soh | 74/7 C |
| 6,782,770 | B2 | 8/2004 | Saito et al. | |
| 6,828,707 | B2 | 12/2004 | Hasegawa et al. | |

FOREIGN PATENT DOCUMENTS

| | | |
|---|---|---|
| JP | U 58-96059 | 6/1983 |
| JP | A-62-168964 | 7/1987 |
| JP | A-63-111315 | 5/1988 |
| JP | A-64-56966 | 3/1989 |

(Continued)

OTHER PUBLICATIONS

Translation of Japanese Patent Office Action in JP-A-2003-356344, Jan. 29, 2008.

*Primary Examiner*—David M Fenstermacher
(74) *Attorney, Agent, or Firm*—Oliff & Berridge, PLC

(57) ABSTRACT

A starter for cranking an internal combustion engine includes an electric motor, an output shaft, and a one-way clutch for transmitting a rotational torque of the electric motor to the output shaft. The one-way clutch is composed of a clutch-outer driven by the electric motor, a clutch-inner spline-coupled to the output shaft, and rollers disposed between the clutch-outer and the clutch-inner. A portion of the clutch-inner is utilized as an inner ring of a ball bearing rotatably supporting the clutch-inner. A ball-groove rotatably supporting the bearing balls and retaining lubricant therein is formed on the outer circumference of the clutch-inner. In this manner, an original inner ring of the ball bearing can be eliminated without adversely affecting the lubricating function.

10 Claims, 4 Drawing Sheets

FOREIGN PATENT DOCUMENTS

| | | |
|---|---|---|
| JP | A-02-086961 | 3/1990 |
| JP | Y2 6-23742 | 6/1994 |
| JP | A-07-167151 | 7/1995 |
| JP | A-8-170575 | 7/1996 |
| JP | A-10-184695 | 7/1998 |
| JP | A 2002-340049 | 11/2002 |
| JP | A-2003-074449 | 3/2003 |
| JP | A-2003-139024 | 5/2003 |
| KR | Y1-20-0167035 | 2/2000 |

* cited by examiner

STARTER WITH ONE-WAY CLUTCH FOR CRANKING INTERNAL COMBUSTION ENGINE

CROSS-REFERENCE TO RELATED APPLICATION

This application is based upon and claims benefit of priority of Japanese Patent Application No. 2003-356344 filed on Oct. 16, 2003, the content of which is incorporated herein by reference.

BACKGROUND OF THE INVENTION

1. Field of the Invention

The present invention relates to a starter for cranking an internal combustion engine, the starter having a one-way clutch.

2. Description of Related Art

An example of a starter having a one-way clutch is disclosed in JP-U-6-23742. A relevant portion of this starter is shown in FIG. 5 attached hereto. The one-way clutch 140 of this starter has a clutch-inner 130 that is coupled to an output shaft 150 by means of a helical spline. The clutch-inner 120 is rotatably supported by a ball bearing 100 which is held in a frame 110. A front portion 120 of the clutch-inner 130 is inserted into an inner ring of the ball bearing 100. The output shaft 150 having a pinion at its front end is pushed forward toward a ring gear of an engine so that the pinion engages with the ring gear. A rotational torque of an electric motor contained in the starter is transmitted to the output shaft 150 via the one-way clutch 140. In a starter disclosed in JP-U-58-96059, a ball bearing is arranged so that balls of the ball bearing directly contact a rotating shaft, thereby eliminating an inner ring of the bearing.

In the starter disclosed in JP-U-6-23742, the outer diameter of the clutch-inner 130 that carries the ball bearing 100 thereon cannot be freely designed because the outer diameter has to fit the inner diameter of the inner ring of the ball bearing 100. If the outer diameter of the clutch-inner 130 is enlarged to increase its mechanical strength, a larger ball bearing 100 has to be used. This makes the size of the starter large. It may be possible to use a specially designed ball bearing to suppress the size of the starter. This makes the starter expensive.

In the starter disclosed in JP-U-58-96059, the balls of the ball bearing directly contact a cylindrical outer circumference of the rotating shaft. Accordingly, it is impossible to retain lubricant on the shaft. If there is some lubricant adhering to the rotating shaft, the lubricant would be positioned apart from the balls when the rotating shaft shifts forward. Therefore, when the rotating shaft is driven by the engine via the pinion at a high speed, it is highly possible that seizing (or burn-in) occurs between the bearing balls and the rotating shaft. This is highly detrimental to durability of the starter. Further, foreign particles or dusts on the rotating shaft will be rolled in to the balls, thereby causing high abrasion.

SUMMARY OF THE INVENTION

The present invention has been made in view of the above-mentioned problems, and an object of the present invention is to provide an improved starter, in which a clutch-inner of a one-way clutch is utilized as an inner ring of a ball bearing. By eliminating the inner ring of the ball bearing, the starter can be made compact while providing good lubrication for rotating members.

The starter for cranking an internal combustion engine is composed of an electric motor, a speed-reduction device for reducing a rotational speed of the electric motor, an output shaft having a pinion engaging with a ring gear of the engine, and a one-way clutch disposed between the speed-reduction device and the output shaft for transmitting the rotational torque of the electric motor to the output shaft while intercepting torque transmission from the output shaft to the electric motor. These components of the starter are supported by or contained in a starter frame.

The one-way clutch includes a clutch-outer driven by the output torque of the speed-reduction device, a clutch-inner spline-coupled to the output shaft and rollers disposed between the clutch-outer and the clutch-inner. The clutch-inner is rotatably supported by a ball bearing held in the starter frame, and the output shaft spline-coupled to the clutch-inner is slidable in the axial direction. The clutch-inner has a tubular shape and includes a clutch-inner portion serving as the clutch-inner and a bearing portion serving as an inner ring of the ball bearing. Thus, a portion of the clutch-inner is utilized as the inner ring of the ball bearing, and the original inner ring of the ball bearing is eliminated. The ball bearing utilizing the portion of the clutch-inner is formed as an integral unit.

A ball-groove for rotatably supporting bearing balls therein is formed on the outer circumference of the bearing portion of the clutch-inner, and lubricant such as grease is retained in the ball-groove. The bearing portion may be formed at both ends of the clutch-inner so that the clutch-inner is supported by two ball bearings positioned at both ends. The ball-groove may be open to the axial end of the clutch-inner so that the ball bearing and the clutch-inner are easily assembled or disassembled. The diameter of the clutch-inner portion serving as the clutch-inner may be made a little larger than the diameter of the bearing portion serving as the inner ring of the ball bearing to make a step between both portions. A washer for receiving a thrust load of the rollers of the one-way clutch may be supported or held by the step.

Since a portion of the clutch-inner is utilized as the inner ring of the ball bearing and the ball bearing including the clutch-inner is formed as an integral unit, the number of components forming the starter is reduced and the assembling process is simplified. Since the clutch-inner can be made thicker by eliminating the inner ring of the ball bearing, mechanical strength of the clutch-inner can be enhanced. Alternatively, a load bearable by the ball bearing can be increased without enlarging the outer diameter of the ball bearing.

Other objects and features of the present invention will become more readily apparent from a better understanding of the preferred embodiments described below with reference to the following drawings.

DETAILED DESCRIPTION OF THE PREFERRED EMBODIMENTS

Figure 1:
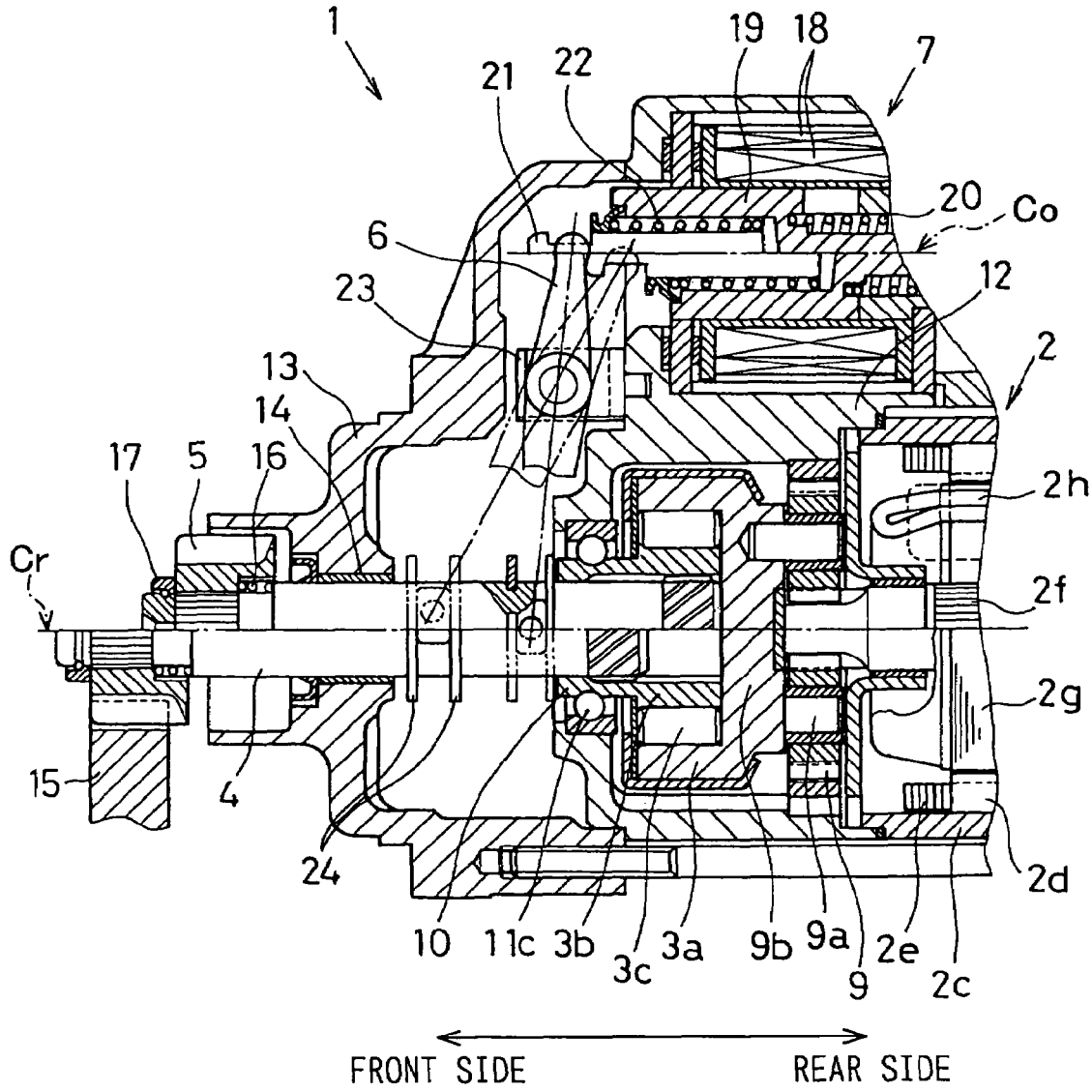
FIG. 1 is a cross-sectional view showing a front portion of a starter for cranking an internal combustion engine, as a first embodiment of the present invention.

A first embodiment of the present invention will be described with reference to FIGS. 1-3. In FIG. 1, an operating position of an output shaft 4 is shown below a rotation centerline Cr, and an initial position (rest position) thereof is shown above the rotation centerline Cr. Similarly, an operating position of a plunger 19 is shown below an operation centerline Co, and an initial position thereof is shown above the operation centerline Co.

A starter 1 is composed of: an electric motor 2 powered by an on-board battery 8 (FIG. 3); a planetary gear speed-reduction device for reducing a rotational speed of the electric motor 2; a one-way clutch 3 (FIG. 2) for transmitting a rotational torque of the speed-reduction device to an output shaft 4; a pinion 5 connected to the output shaft 4; a magnetic switch 7 for selectively closing a circuit for supplying electric power to the electric motor 2 and for shifting the output shaft 4 forward via a shift lever 6; and other associated components.

The electric motor 2 is a known direct current motor having a rotatable armature 2*a* (FIG. 3) and a stator generating a magnetic field therein. When the power supply circuit is closed by the magnetic switch 7, electric power is supplied to the electric motor 2 from the on-board battery 8. The electric power is supplied to the armature 2*a* through brushes 2*b* slidably contacting a commutator connected to the armature 2*a*. The stator is composed of a cylindrical yoke 2*c*, poles 2*d* connected to an inner bore of the yoke 2*c* and field coils 2*e* wound around each pole 2*d*. The stator may be replaced with a stator having permanent magnets. The armature 2*a* is composed of an armature shaft 2*f*, an armature core 2*g* fixedly connected to the armature shaft 2*f*, an armature coil 2*h* wound around the armature core 2*g* and a commutator electrically connected to the armature coil 2*h*.

The planetary gear speed-reduction device is a known type of the speed-reduction mechanism, which is composed of a sun gear integrally formed with the armature shaft 2*f*, planetary gears 9 engaging with and orbiting around the sun gear, an internal gear with which the planetary gears engage, and a gear carrier 9*b* to which the planetary gears 9 are rotatably connected via gear shafts 9*a*. A rotational speed of the armature 2*a* is reduced by the planetary gear speed-reduction device and is transmitted to a clutch-outer 3*a* which is integrally formed with the gear carrier 9*b*.

Figure 2:
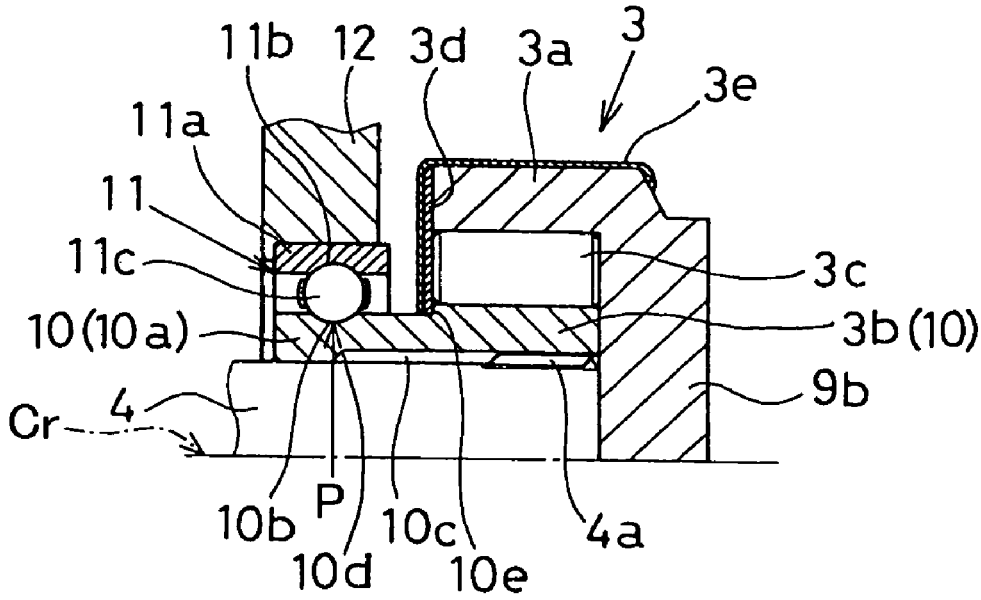
FIG. 2 is a cross-sectional view showing a relevant portion of a one-way clutch used in the starter shown in FIG. 1.

As shown in FIG. 2, the one-way clutch 3 is composed of the clutch-outer 3*a*, a clutch-inner 10 in a tubular shape and rollers 3*c* disposed between the clutch-outer 3*a* and the clutch-inner 10. Axial movement of the rollers 3*c* is restricted by a washer 3*d* covered with a clutch cover 3*e*. The clutch-inner 10 includes a clutch-inner portion 3*b* and a bearing portion 10*a* that serves as an inner ring of a ball bearing 11. The ball bearing 11 is composed of an outer ring 11*a*, the bearing portion 10*a* (serving as an inner ring) and the balls 11*c* disposed between the outer ring 11*a* and the bearing portion 10*a*. In other words, the clutch-inner 10 forms the ball bearing 11 together with other components. A ball-groove 10*b* having an arc cross-section is formed on the outer circumference of the bearing portion 10*a*, and the balls 11*c* are rotatably supported therein. The outer ring 11*a* of the bearing 11 is press-fitted or free-fitted (running fit) in a bearing hole formed in a center case 12, which is firmly held between a front housing 13 and the yoke 2*c*, forming a starter frame, as shown in FIG. 1. The planetary gear speed-reduction device and the one-way clutch 3 are contained in the center case 12.

A female helical spline 10*c* is formed in the inner bore of the clutch-inner 10. The female helical spline 10*c* extends from a rear axial end (the right side in FIG. 2) of the clutch-inner 10 to a position P where the bottom of the ball-groove 10*b* (the position where the ball-groove 10*b* is deepest) is located. A stopper 10*d* is formed at the position P, so that the output shaft 4 is stopped by the stopper 10*d* when the output shaft 4 is shifted forward (toward the front side of the starter).

As shown in FIG. 2, the outer diameter of the clutch-inner portion 3*b* is made larger than the outer diameter of the bearing portion 10*a*, thereby forming a step 10*e*. The step 10*e* engages with an inner hole of the washer 3*d* and receives a thrust load applied to the washer 3*d*. Axial movement of the rollers 3*c* is restricted by the washer 3*d* which is in turn fixed to the clutch-outer 3*a* by staking the clutch cover 3*e*.

A front portion of the output shaft 4 is rotatably supported by a bearing 14 held in the front housing 13, and a rear portion of the output shaft 4 is inserted into the clutch-inner 10 which is rotatably supported by the bearing 11 held in the center case 12. A male helical spline 4*a* is formed on the rear portion of the output shaft 4, as shown in FIGS. 1 and 2. The male helical spline 4*a* is coupled to the female spline 10*c* of the clutch-inner 10 so that the output shaft 4 is slidable in the clutch-inner 10 in the axial direction.

The pinion 5, which engages with a ring gear 15 of the engine to crank up the engine, is connected to the front end of the output shaft 4 by means of a straight spline. The pinion 5 is biased toward the front side by a pinion spring 16 and stopped by abutting a collar 17 fixed to the front end of the output shaft 4. The pinion 5 can move back toward the rear side up to a position where the pinion spring 16 is fully compressed when the pinion 5 abuts the ring gear 15.

Figure 3:
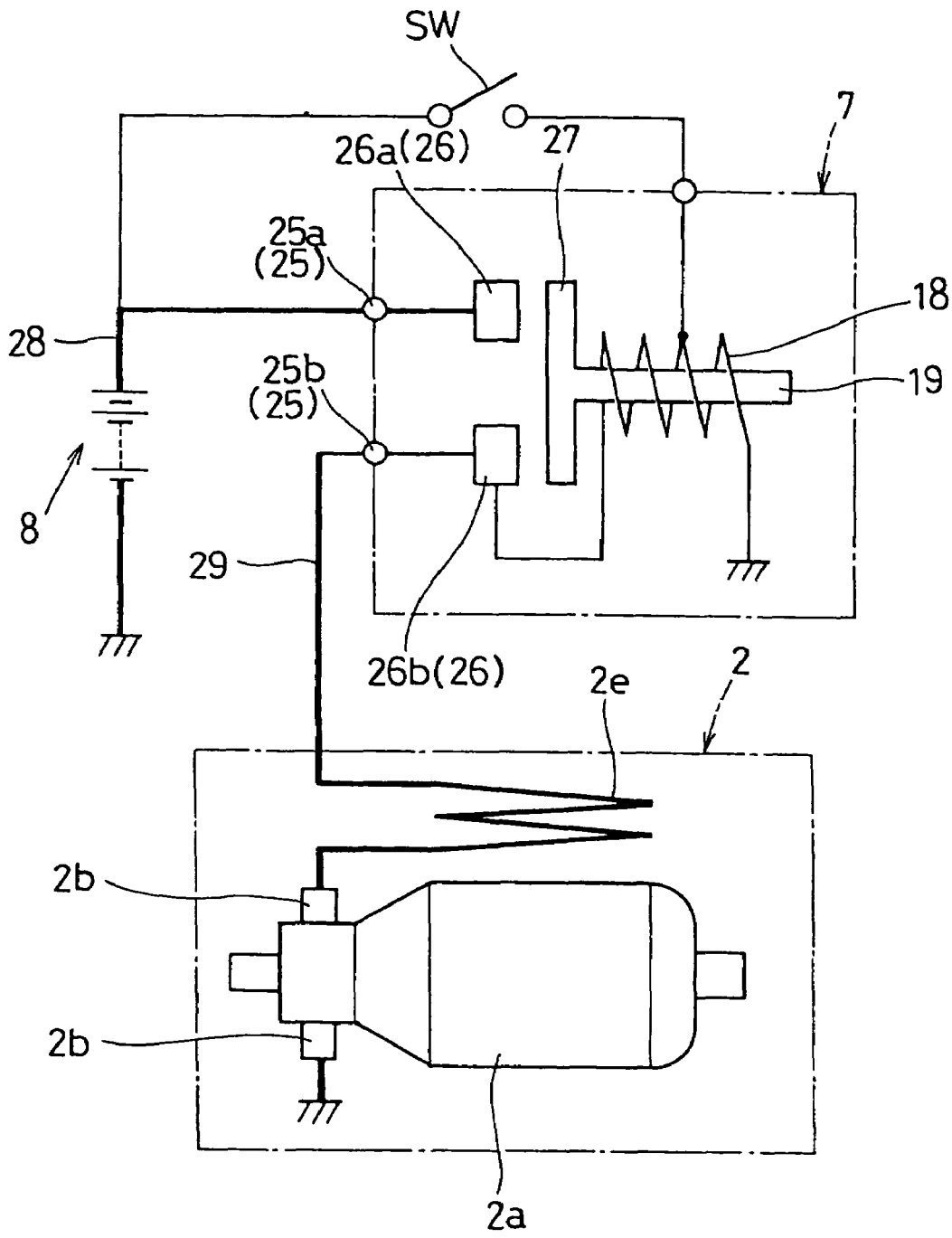
FIG. 3 is a circuit diagram showing electrical connections in the starter.

As shown in FIGS. 1 and 3, the magnetic switch 7 is composed of: an excitation coil 18 that is energized when electric power is supplied from the battery 8; a plunger 19 driven by magnetic force generated in the excitation coil 18; a return spring 20 that returns the plunger 19 to its initial position when the magnetic force disappears; a hook 21 inserted into the plunger 19 to be driven by the plunger 19; and a drive spring 22 disposed between the plunger 19 and the hook 21. An upper end of the shift lever 6 is connected to the hook 21, and a lower end of the shift lever 6 is coupled to a pair of ring washers 24 connected to the output shaft 4. The shift lever 6 is pivotally supported by a lever holder 23. The output shaft 4 is shifted in the axial direction according to movement of the plunger 19.

As shown in FIG. 3, the power supply circuit in the magnetic switch 7 is composed of: a pair of terminals 25 (a battery terminal 25*a* connected to the battery 8 through a battery cable 28 and a motor terminal 25*b* connected to the field coil 2*e* through a motor lead 29); a pair of stationary contacts 26 (a stationary contact 26*a* connected to the battery terminal 25*a* and a stationary contact 26*b* connected to the motor terminal 25*b*); and a movable contact 27 connected to the plunger 19 to be driven thereby. The pair of terminals 25 are connected to a switch cover of the magnetic switch 7. The power supply circuit is closed when the movable contact 27 contacts the pair of stationary contacts 26.

Operation of the starter 1 described above will be briefly explained. Upon closing a starter switch SW, the excitation coil 18 is energized, and the plunger 19 is driven toward the rear side. According to the movement of the plunger 19, the output shaft 4 is shifted to the front side by the shift lever 6. When the pinion 5 smoothly engages with the ring gear 15, the power supply circuit is closed and the armature 2*a* is rotated. When the pinion 5 abuts the ring gear 15 without engaging, the pinion 5 moves backward relative to the output shaft 4, compressing the pinion spring 16, and slowly rotates relative to the ring gear 15. When the pinion 5 rotates to an engageable position, the pinion 5 is pushed forward by the pinion spring 16 and engages with the ring gear 15. After the engagement is established, the power supply circuit is closed, and thereby the engine is cranked up by the rotational torque of the armature 2*a*. After the engine is cranked up, the starter switch SW is opened to terminate a series of starting operation.

Following advantages are attained in the starter described above. Since the portion of the clutch-inner 10 is utilized as an inner ring of the bearing 11, the inner ring of the ball bearing 11 is eliminated, thereby reducing the number of components. Since the clutch-inner 10 is an integral part of the ball bearing 11, the assembling process is simplified, eliminating a process of press-fitting the clutch-inner 10 into the ball bearing 11. Since the inner ring of the ball bearing 11 is eliminated, the thickness of the clutch-inner 10 can be made thicker to thereby increase mechanical strength of the clutch-inner 10 without increasing the outer diameter of the ball bearing 11. Alternatively, the ball size can be increased to increase a bearable load of the ball bearing 11.

Since the outer diameter of the bearing portion 10*a* can be made larger by eliminating the inner ring of the ball bearing 11, the female helical spline 10*c* can be extended to the position P which is located underneath the ball-groove 10*b* without reducing the mechanical strength. Accordingly, a length from the front end of the bearing portion 10*a* to the position P can be made short, and thereby a total length of the clutch-inner 10 can be shortened. Since the step 10*e* for receiving a thrust load of the washer 3*d* is formed on the clutch-inner 10, no other structure supporting the washer 3*d* is necessary. The step 3*d* may be made by making the outer diameter of the bearing portion 10*a* larger than that of the clutch-inner portion 3*b*.

Since the ball-groove 10*b* supporting the balls 11*c* therein is formed on the bearing portion 10*a*, the lubricant is retained in the ball-groove 10*b* to thereby prevent burn-in or seizing between the balls 11*c* and the bearing portion 10*a*. Further, since only the output shaft 4 is shifted without moving the one-way clutch 3, the lubricant can be retained for a long time, thereby securing a long life of the starter.

Figure 4:
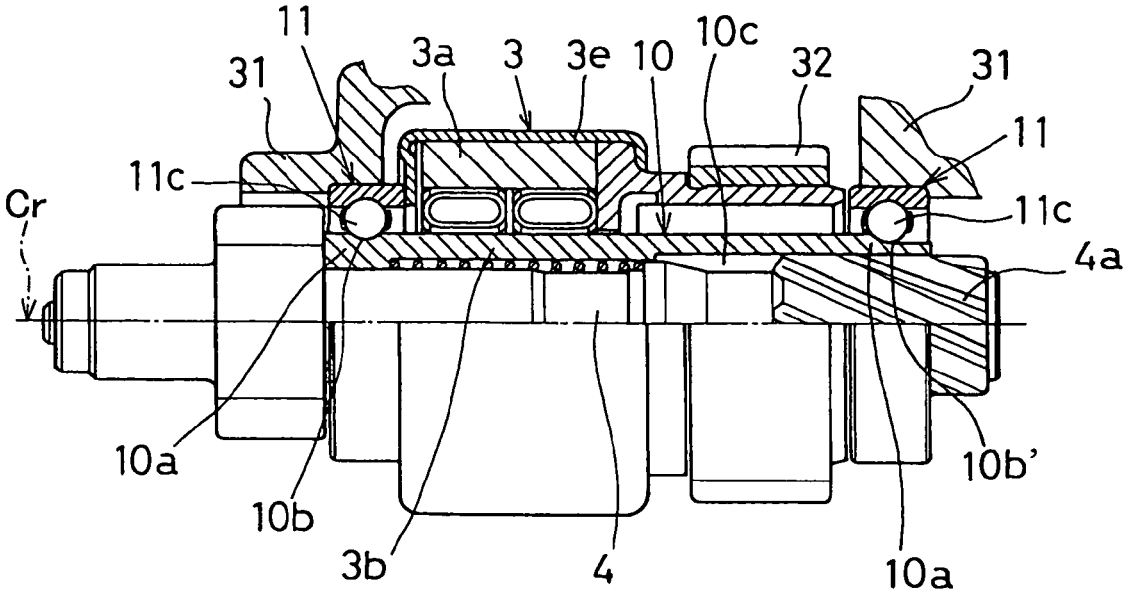
FIG. 4 is a cross-sectional view showing a one-way clutch and associated members, as a second embodiment of the present invention.
Figure 5:
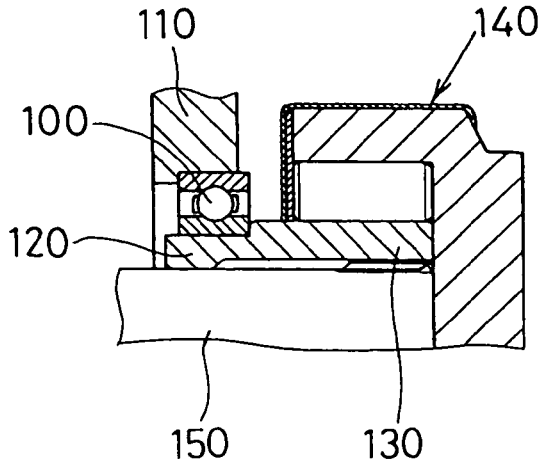
FIG. 5 PRIOR ART
FIG. 5 is a cross-sectional view showing a relevant portion of a one-way clutch used in a conventional starter.

A second embodiment of the present invention will be described with reference to FIG. 4. In this embodiment, a clutch-inner 10 which is longer than that of the first embodiment is used, and the longer clutch-inner 10 is rotatably supported by a pair of ball bearings 11 disposed at both ends of the clutch-inner 10. The output shaft 4 is coupled to the clutch-inner 10 by means of a helical spline to be movable in the axial direction in the same manner as in the first embodiment. The pair of ball bearings 11 are supported in frame 31 constituting a housing of the starter. The clutch-outer 3*a* is driven by a clutch gear 32 connected to the clutch-outer 3*a*. The clutch gear 32 is driven by the electric motor 2 via a speed-reduction device.

A bearing portion 10*a* having a ball-groove 10*b* is formed at the front end of the clutch-inner 10, and the bearing portion 10*a* is utilized as an inner ring of the ball bearing 11 in the same manner as in the first embodiment. Another bearing portion 10*a* having a ball-groove 10*b*′ is formed at the rear end of the clutch-inner 10, and this bearing portion 10*a* is similarly utilized as an inner ring of the ball bearing 10*a* disposed at the rear end of the clutch-inner 10. The ball-groove 10*b*′ formed at the rear end of the clutch-inner 10 has a shape different from that of the ball-groove 10*b* formed at the front end. As shown in FIG. 4, the ball-groove 10*b*′ is a half groove open to the rear end of the clutch-inner 10. By opening the ball-groove 10*b*′ to the rear end of the clutch-inner 10, the ball bearing 11 can be easily assembled or disassembled. The ball-groove 10*b* formed at the front end may be formed in the same manner as the ball-groove 10*b*′ formed at the rear end. It is also possible to form the ball-groove 10*b* in the first embodiment (shown in FIG. 2) in the same shape as the ball-groove 10*b*′.

The present invention is not limited to the embodiments described above, but it maybe variously modified. For example, speed reduction devices other than the planetary gear-speed reduction device can be used in the starter having the one-way clutch according to the present invention. While the present invention has been shown and described with reference to the foregoing preferred embodiments, it will be apparent to those skilled in the art that changes in form and detail may be made therein without departing from the scope of the invention as defined in the appended claims.

What is claimed is:

1. A starter for cranking an internal combustion engine mounted on an automotive vehicle having an on-board battery, the starter comprising:

an electric motor powered by the on-board battery;

an output shaft adapted to be driven by the electric motor;

a one-way clutch for transmitting a rotational torque of the electric motor to the output shaft, the one-way clutch comprising a tubular clutch-inner that is spline-coupled to the output shaft, a clutch-outer driven by the electric motor and rollers disposed between the clutch-inner and the clutch-outer for transmitting a rotational torque of the clutch-outer to the clutch-inner; and a ball bearing held in a frame of the starter for rotatably supporting the clutch-inner, wherein a portion of the clutch-inner is utilized as a bearing portion serving as an inner ring of the ball bearing, and a ball-groove for rotatably supporting balls of the ball bearing therein is formed on outer circumference of the bearing portion.

2. The starter as in claim 1, wherein:

the bearing portion of the clutch-inner is formed at a front end of the clutch-inner; and a female spline coupled to a male spline of the output shaft is formed on an inner bore of the clutch-inner, the female spline extending from a rear end of the clutch-inner toward the front end thereof and being terminated at a position where a bottom of the ball-groove is located.

3. The starter as in claim 1, wherein:

the bearing portion of the clutch-inner is formed at a front end and a rear end of the clutch-inner; and the ball-groove is formed on the outer circumference of both the bearing portions formed at the front end and the rear end of the clutch-inner.

4. The starter as in claim 2, wherein:

the ball-groove formed on the outer circumference of the bearing portion is open to the front end of the clutch-inner, keeping a diameter of the clutch-inner corresponding to the bottom of the ball-groove constant from the position where the bottom of the ball-groove is located to the front end of the clutch-inner.

5. The starter as in claim 3, wherein:

either one, or both, of the ball-grooves are open to the respective ends of the clutch-inner, keeping a diameter of the clutch-inner corresponding to the bottom of the ball-groove constant from the position where the bottom of the ball-groove is located to the respective ends of the clutch-inner.

6. The starter as in claim 1, wherein:

the starter further includes a device for reducing a rotational speed of the electric motor.

7. The starter as in claim 6, wherein:

the device for reducing a rotational speed of the electric motor is a planetary gear speed-reduction device connected between the electric motor and the clutch-outer of the one-way clutch.

8. The starter as in claim 1, wherein:

a clutch-inner portion having an outer diameter different from that of the bearing portion is formed next to the bearing portion, forming a step at a boundary between the bearing portion and the clutch-inner portion; and the one-way clutch further includes a ring-shaped washer for receiving a thrust load of the rollers, and the inner diameter of the washer is supported by the step.

9. The starter as in claim 1, wherein:

the ball bearing is held in a bearing hole of the frame of the starter by means of running fit.

10. The starter as in claim 1, wherein:

the ball bearing is held in a bearing hole of the frame of the starter by means of press-fit.

* * * * *